US005584469A

United States Patent [19]

Goodwin

[11] Patent Number: 5,584,469

[45] Date of Patent: Dec. 17, 1996

[54] HANDRAIL ASSEMBLY

[75] Inventor: David Goodwin, Surrey, United Kingdom

[73] Assignee: Kee Klamps Limited, London, England

[21] Appl. No.: 381,913

[22] PCT Filed: Aug. 3, 1993

[86] PCT No.: PCT/GB93/01634

§ 371 Date: Feb. 13, 1995

§ 102(e) Date: Feb. 13, 1995

[87] PCT Pub. No.: WO94/04860

PCT Pub. Date: Mar. 3, 1994

[30] Foreign Application Priority Data

Aug. 15, 1992 [GB] United Kingdom ..... 9217405

[51] Int. Cl.[6] ..... E04H 17/14

[52] U.S. Cl. ..... 256/65; 256/59; 256/67; 256/69

[58] Field of Search ..... 256/59, 65, 67, 256/68, 69, 70

[56] References Cited

U.S. PATENT DOCUMENTS

| | | | |
|---|---|---|---|
| 699,509 | 5/1902 | Finnegan | 256/67 |
| 1,110,018 | 9/1914 | Bonham | 256/65 X |
| 1,316,155 | 9/1919 | Harrison et al. | 256/65 |
| 2,754,092 | 7/1956 | Cremens | 256/65 X |
| 2,999,671 | 9/1961 | Blayden | 256/67 X |
| 3,254,885 | 6/1966 | Rumsey | 403/90 X |
| 4,150,907 | 4/1979 | Thurnauer | 256/69 X |
| 4,923,176 | 5/1990 | Heinz | 256/65 |
| 4,928,930 | 5/1990 | Chung | 256/67 |
| 5,026,028 | 6/1991 | Ooi et al. | 256/67 |
| 5,382,111 | 1/1995 | Melashenko et al. | 256/65 X |
| 5,437,433 | 8/1995 | Rezek | 256/67 |

FOREIGN PATENT DOCUMENTS

| | | | |
|---|---|---|---|
| 2013449 | 9/1971 | Germany | 256/65 |
| 107051 | 5/1991 | Japan | 256/59 |
| 122357 | 5/1991 | Japan | 256/59 |
| 148968 | 6/1993 | Japan | 256/59 |
| 180025 | 7/1962 | Sweden | 256/65 |
| 2192209 | 1/1988 | United Kingdom | 256/59 |

*Primary Examiner*—Kenneth J. Dorner
*Assistant Examiner*—Andrea Chop
*Attorney, Agent, or Firm*—Young & Thompson

[57] ABSTRACT

A handrail assembly comprises a substantially continuous length of handrail having therein a longitudinally extending groove and a connector device (12,72) which enables a support post to be secured in a selected orientation relative to the length of the handrail. The connector device comprises a first member (72) which is an insert slidable lengthwise of the handrail in the longitudinally extending groove in the handrail (70), a second member (12) adjustably associated with the first member by a retention assembly (48), the first member having formed in an external surface thereof a recess (30') of part spherical shape, the second member (12) comprising an elongate body having a hollow head portion (40) and a tubular tail portion (43), these portions being aligned with one another along the longitudinal axis of the body. The head portion (40) of the second member comprises a part-spherical outer surface (41) which conforms with the shape of the recess (30') in the first member. The head portion provides an adjustment slot (46), the retention assembly (48) being arranged to extend at least in part through this slot (46) and be adjustable such that the first and second members may be either restrained against relative movement or be free for relative pivotal movement upon relative sliding movement of the confronting part spherical surfaces (30', 41).

20 Claims, 4 Drawing Sheets

HANDRAIL ASSEMBLY

FIELD OF THE INVENTION

This invention relates to a handrail assembly which is adjustable for interconnection of two handrail components, such as two tubes, to lie in any of a range of positions relative to one another.

Examples of known handrail connector devices are described in DE-U-8832774 and BE-A-883102.

BACKGROUND OF THE INVENTION

Connector devices for securing a tubular member to another tubular member or for example to support structure are used commonly in the construction of handrails and balustrades. The connector devices usually are required to provide a smooth surface in combination with the end of a tube to which they are connected and to interconnect with that tube in a tamper resistant manner. A difficulty arises in that a considerable number of such connectors are needed, and are required to be held in stock, in order to interconnect different size tubes and allow interconnection of the tubes at any of a range of relative positions. Articulated type connection devices have been proposed but these generally suffer the disadvantage of being incompatible with providing a smooth and tamper resistant interconnection.

OBJECT OF THE INVENTION

The present invention seeks to provide an improved handrail assembly which lends itself readily to provision of an interconnection between a handrail and a support post whereby said handrail and support post can lie in a position relative to one another selected from any of a range of relative positions.

SUMMARY OF THE INVENTION

In accordance with one of its aspects the present invention provides a handrail assembly comprising a substantially continuous length of handrail and a connector device which enables a support post to be secured in a selected orientation relative to the length of the handrail, the connector device comprising a first member which is an insert located in part of said continuous length of handrail, a second member adjustably associated with the first member by means of a retention assembly, the first member having formed in an external surface thereof a recess of part spherical shape, the second member comprising a substantially elongate body having a hollow head portion and a substantially tubular tail portion, said portions being substantially aligned with one another along the longitudinal axis of the body, the head portion of the second member comprising a part spherical outer surface which conforms substantially with the shape of the recess in the first member, said head portion being shaped to provide a slot, the retention assembly being arranged to extend at least in part through said slot and be adjustable such that the first and second members may be either restrained against said relative movement or be substantially free for relative pivotal movement upon relative sliding movement of said confronting part spherical surfaces.

The first member may be a solid rod, a tube (typically of a thick walled type to allow for provision of the recess) or other member.

The first member at least in part may be in the form of substantially solid, e.g. cast component.

The insert may be slidable in a groove which extends longitudinally in a handrail.

A washer of resilient material such as a resilient plastics or elastomeric material may be provided in a base region of the recess and thereby serve to provide resistance to relative movement of the first and second member unless the retention assembly is in a fully released condition.

The retention assembly may comprise a screw-threaded formation associated with the first member and engageable by a screw-threaded formation of a retention member. However, other retention formations may be employed, e.g. bayonet, ribbed or friction fit type formations.

Preferably the slot extends through at least 30° and more preferably extends through an angle of greater than or equal to 45° relative to the longitudinal axis of the second member such that said second member may be secured relative to the first member at any of a range of relative positions lying within an angle range of 45° to 90°.

In accordance with the present invention it is preferred that the slot in the hollow head portion of the second member extends substantially only to one side of the longitudinal axis. It may extend slightly to the other side so as to accommodate the cross-sectional dimension of a part of the retention assembly and allow the second member to be secured at right angles to the first member. However, a greater extension of the slot to said other side of the longitudinal axis generally will not be preferred insofar as the end of the slot could become undesirably exposed if the first and second members are secured together at one of the extremes of the range of possible relative positions.

To assist in concealing the slot at all relative positions it is preferred that the part spherical recess, as considered in cross-section, sub-tend an angle of at least 80°, and more preferably an angle in the range 90° to 100° about its centre of curvature.

The hollow head portion of the second member preferably has a part spherical internal surface dimensioned such that the wall thickness of the head portion, at least in the vicinity of the slot, is substantially uniform.

The tail portion of the second member may be adapted for location in an end of a tube. The tail portion may be of a reduced cross-sectional dimension relative to the maximum cross-sectional dimension of the head portion whereby a tube fitted over the tail portion may abut a step between the head and tail portions and result in a smooth continuous surface between the tube and head portion.

The tail portion may be provided with one or more apertures to facilitate retention of a tube end.

Preferably the axial length of the tail portion is less than twice the axial length of the head portion, the axial length of the head portion typically being equal to the radius of curvature of the external part spherical surface of the head portion.

More preferably the axial length of the tail portion is less than 1.5 of that radius of curvature and more particularly less than or equal to that radius of curvature. Ease of access to retention means located in the head portion is thereby facilitated irrespective of the orientation of the retention member relative to the longitudinal axis of the second member.

Preferably the head portion is of a substantially semi-spherical shape.

The first member may have an outer surface region which is part cylindrical. Preferably that surface has a radius of curvature which is at least equal to and more preferably greater than the radius of curvature of the part spherical recess.

The retention assembly may comprise a head portion adapted to conform to the internal surface of the hollow head portion of the second member, or may be spaced therefrom by an interposed washer having a first surface conforming to the shape of an undersurface of said retention head portion and a second surface which conforms to the internal surface of the hollow head portion of the second member.

The handrail and a support post may each be of a kind having a longitudinal or major axis and the assembly may be orientated such that said axes intersect either for example perpendicular or at an acute angle relative to one another. Alternatively the assembly may be orientated such that said axes are maintained offset, i e such that they do not truly intersect.

The invention further provides an assembly of handrail secured to a corner post at a position where the handrail is curved as viewed vertically in plan and the connector device is orientated such that the longitudinal axis of the post is offset locally relative to the major axis of the handrail.

BRIEF DESCRIPTION OF THE DRAWINGS

Embodiments of the present invention will now be described, by way of example only, with reference to the accompanying diagrammatic drawings in which.

DETAILED DESCRIPTION OF THE INVENTION

Figure 1:
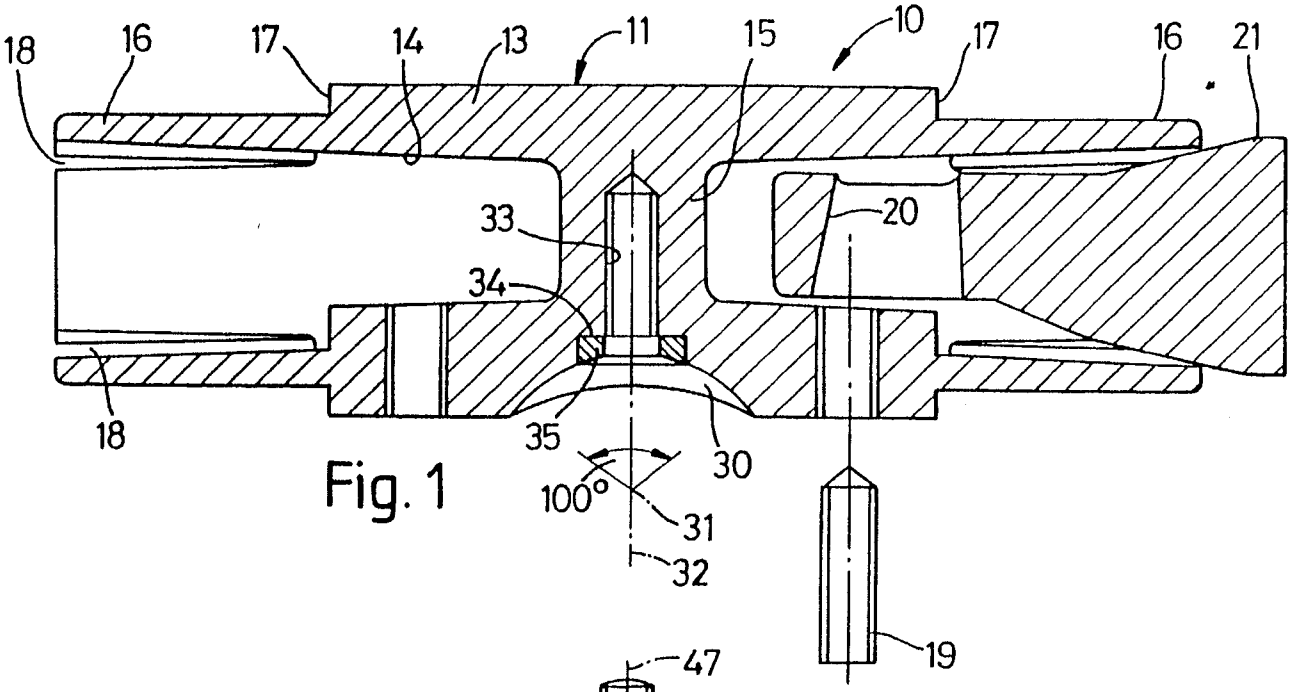
FIG. 1 is a longitudinal cross-sectional view of a first member of a connector device for a handrail assembly in accordance with the present invention.
Figure 2:
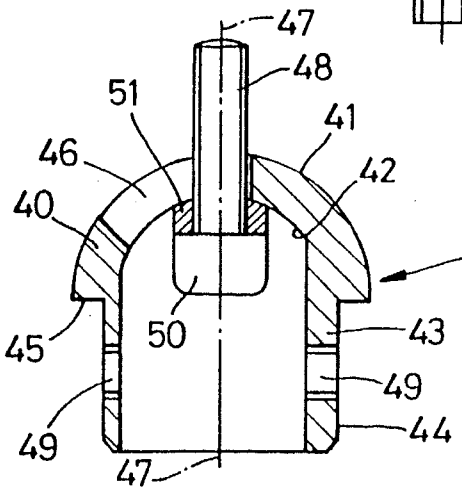
FIG. 2 is a longitudinal cross-sectional view of a second member of the same connector device as that of FIG. 1.

A connector device 10 for a handrail assembly in accordance with the present invention comprises first and second members 11,12 shown in FIGS. 1 and 2 respectively and each formed from cast aluminium alloy.

The first member 11 is of an elongate form having a body of substantially cylindrical shape. The body has a central section 13 the end portions 14 of which are hollow and spaced apart by a central web 15 whereby at the central region the member is substantially solid in cross-section.

Tail portions 16 extend from each end of the central section 13 and are stepped in diameter relative to the central portion such that a tube end fitted over a respective tail portion abuts a step 17 between the tail portion central portion to provide a flush continuous outer surface. An internal locking member 21 an example of which is described in more detail in the specification of our co-pending International Patent Application PCT/GB92/00980 may be used to secure tube ends to the first member, and for that purpose the tail portions 16 have longitudinal slits 18 to facilitate expansion against an internal surface of a tube end. Screws 19 are provided to engage ramps 20 on the internal locking member 21 to draw the locking member towards the centre of the first member and cause the tail portion 16 to expand against a tube inner surface.

The central section 13 is formed in its outer surface with a part spherical recess 30 which, as viewed in longitudinal cross-section as shown in FIG. 1 sub-tends an angle of 100° at the centre of curvature 31 of the surface. The recess is positioned symmetrically about the longitudinal axis 32 of a screw-threaded hole 33 provided in the central web portion 15 of the first member. The central region of the recess is formed with a well portion 34 in which a friction washer 35 is located. The friction washer is dimensioned so as to extend slightly radially outwards of the part spherical surface.

The second member 12 of the connector device is shown in FIG. 2 and comprises a dome-like head portion 40 having part spherical inner 42 and outer surfaces 41. A tubular tail portion 43 depends from the head portion and has a cylindrical outer surface 44 of a diameter less than that of the head portion. An abutment step 45 is formed between the two portions and the diameters of said portions are selected such that a tube may be closely fitted over the tail portion with its outer surface lying substantially flush with the outer surface of the head portion.

The dome-like head portion 40 is provided with a slot 46 which extends radially from the longitudinal axis 47 of the second member through an angle of approximately 45°. It extends also in an opposite direction for a short distance sufficient to allow a retention bolt 48 to lie in the slot in a position aligned with said longitudinal axis 47.

The outer surface 41 of the domed head portion has a radius of curvature corresponding to that of the recess 30 in the first member.

The slot 46 has a constant width in a direction perpendicular to the cross-sectional plane of FIG. 2, that width being slightly greater than the diameter of the retention bolt 48.

The tail portion 43 is provided with apertures 49 which facilitate connection of a tube end by means of a screw-threaded pin in known manner.

The retention member in the form of said bolt 48 has a head portion 50 of a width greater than that of the slot 46 such that the slot holds the head portion captive within the hollow of the second member. A profiled washer 51 is positioned adjacent the underside of the bolt head and has a second surface of part spherical shape so as to bear uniformly against portions of the domed head region either side of the slot.

The tail portion 43 has an axial length which equals the radius of curvature of the outer part spherical surface 41 of the head portion.

Figure 3:
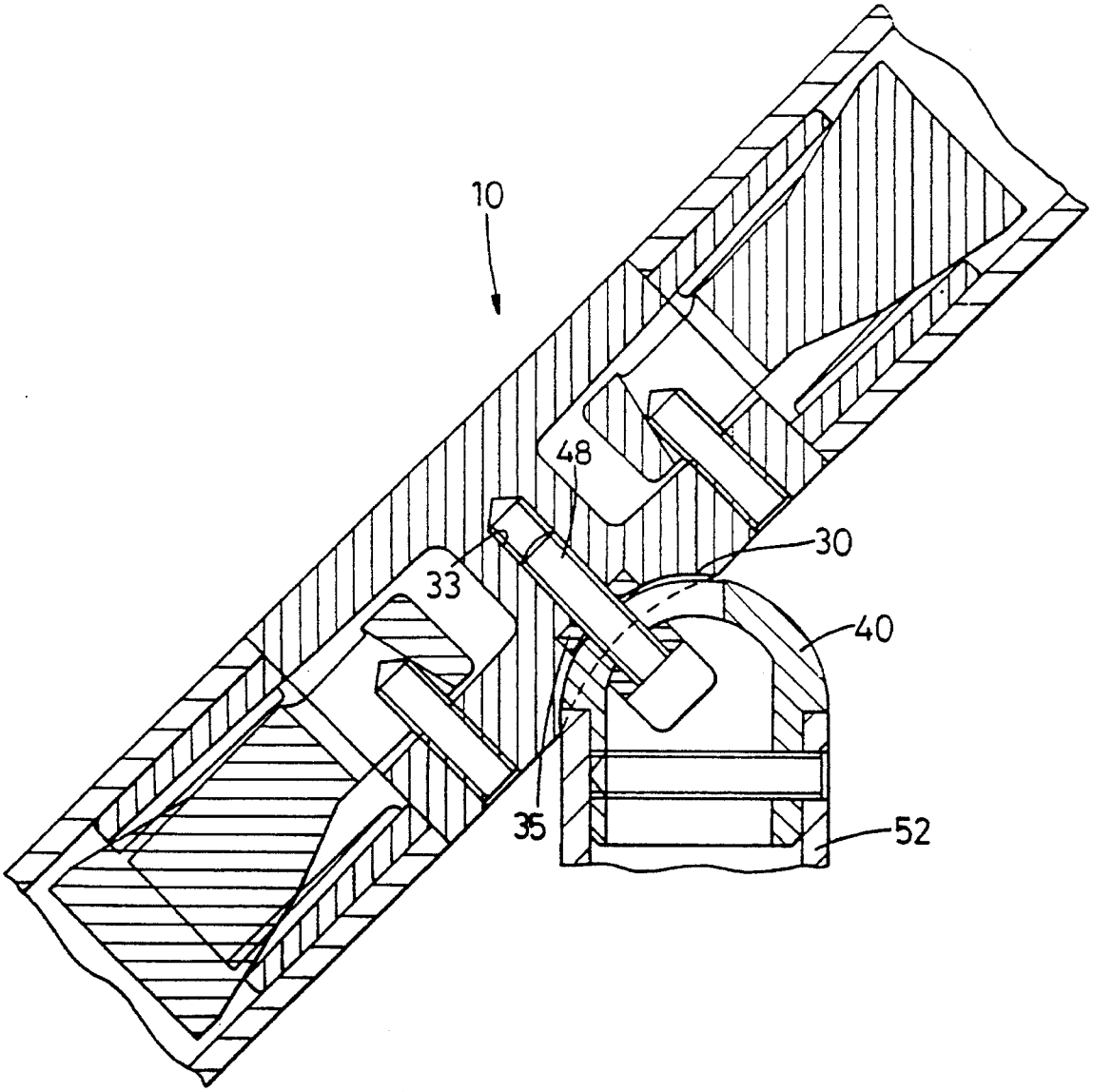
FIG. 3 is a longitudinal sectional view of an assembly comprising the connector device members of FIGS. 1 and 2 in situ to interconnect the ends of three tubes.

In use of the aforedescribed connector device (see FIG. 3) the domed head portion 40 of the second member is positioned in the recess 30 of the first member and the retention bolt 48 is then secured to the retainer thread 33 in the first member. The bolt is tightened fully when the first and second members are in the required relative orientation. By virtue of the relative short length of the tail portion 43 of the second member adequate access to the bolt head is readily achieved to enable full tightening and compression of the friction washer 35. Subsequently a tube end 52 is secured to the tail portion of the second member in known manner.

Although the invention has been described specifically in respect of a first member which is of rectilinear form, it is to be understood that the first member may be of another shape and may for example be curved.

Figure 5:
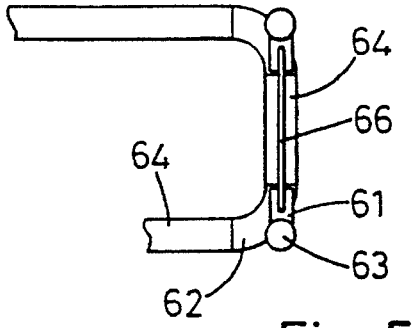
FIGS. 4 and 5 are illustrations of a balustrade installation of the present invention.
Figure 4:
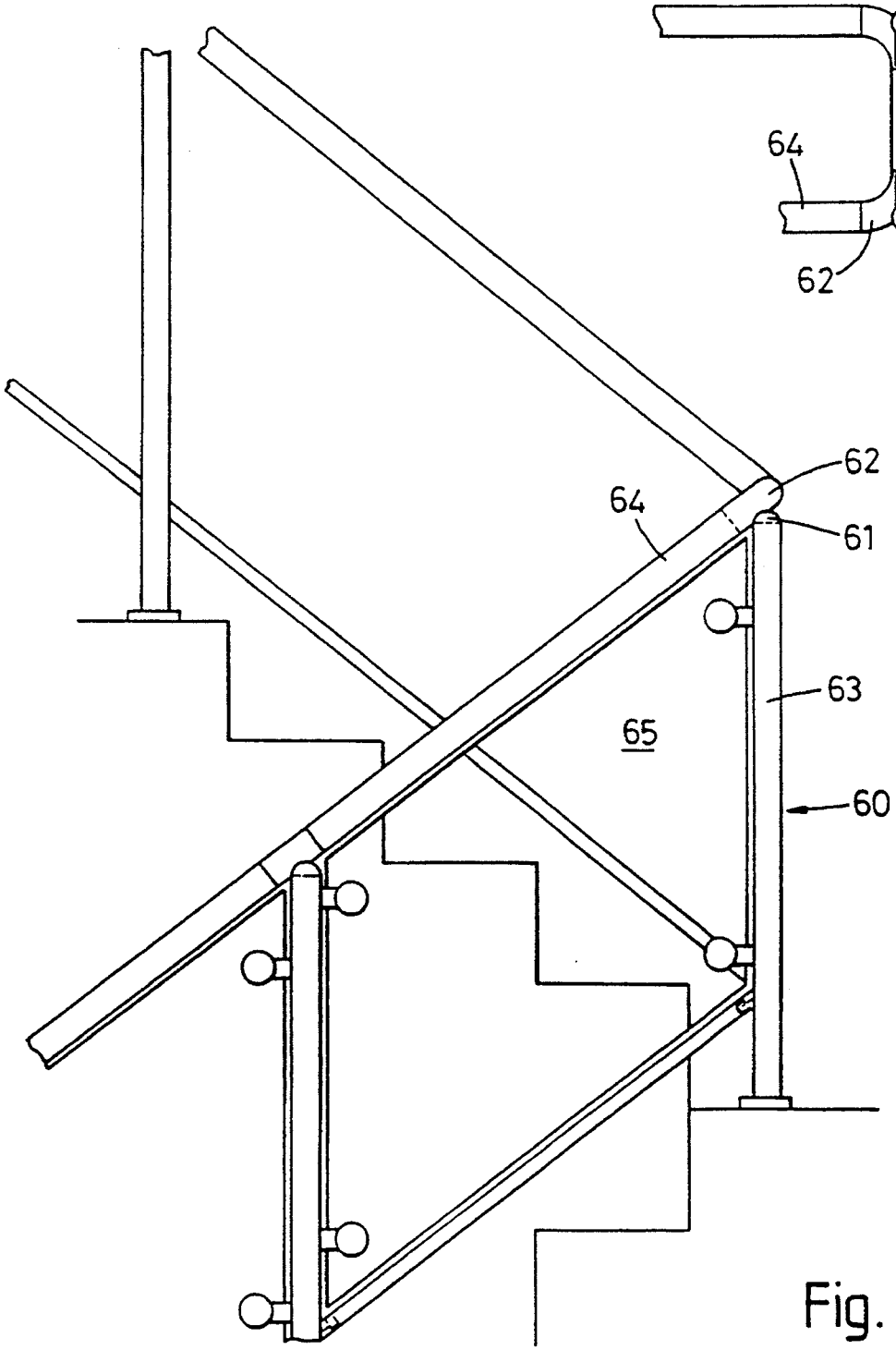

Use of the connector device in a balustrade 60 is illustrated in FIGS. 4 and 5. This shows a connector device 61 in which the first member, a curved handrail section 62, provided with a recess is non-rectilinear and has a curved major axis. The handrail section interconnects two rectilinear handrail sections 64 which lie at right angles to one another as viewed in plan (see FIG. 5). The connector device 61 is orientated such that the longitudinal axis of a vertical tube post 63 secured to the second member of the connector device lies offset relative to the major axis of the first member 62. The offset of the respective axes provides a useful facility position to the vertical post 63 aligned relative to the handrail sections 64 as viewed in plan. Thus a balustrade panel 64 at a turnround region can be positioned to lie aligned under that handrail portion in the same manner as a panel 65 provided under a major section 66 of the handrail.

Figure 6:
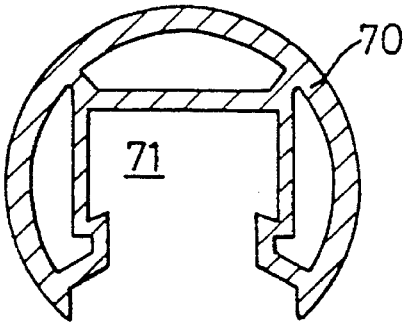
FIG. 6 is a sectional view of a handrail.
Figure 7:
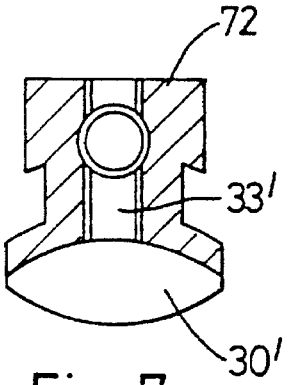
FIG. 7 is an end view of part of another connector device for a handrail assembly of another embodiment of the invention.
Figure 8:
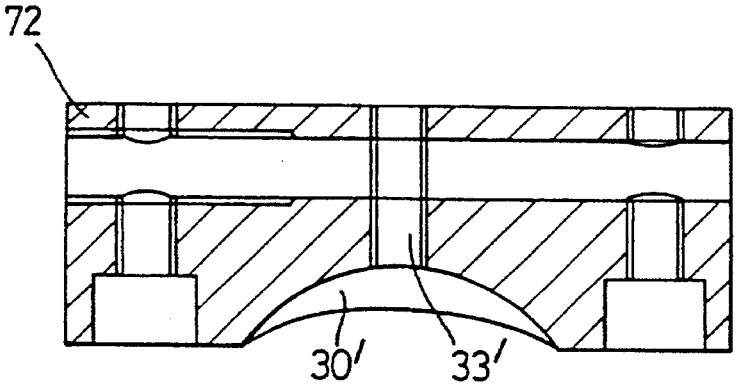
FIG. 8 is a side view of the device of FIG. 7.

The first member need not form part of the length of the handrail. FIG. 6 shows a hollow cross-section handrail 70 having a groove 71 in which a first member in the form of an insert 72 (see FIGS. 7 and 8) is slidably mounted. The insert 72 has a part spherical recess 30' and screw threaded hole 33' substantially as described with reference to FIGS. 1 to 3.

Figure 9:
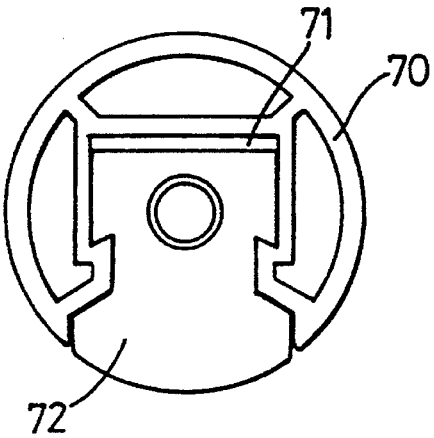
FIG. 9 is an assembly view of the components of FIGS. 6 and 7.

FIG. 9 shows the insert in position in the groove 71. Means, not shown, is provided for locking the insert against movement when slid to the desired position.

Figure 10:
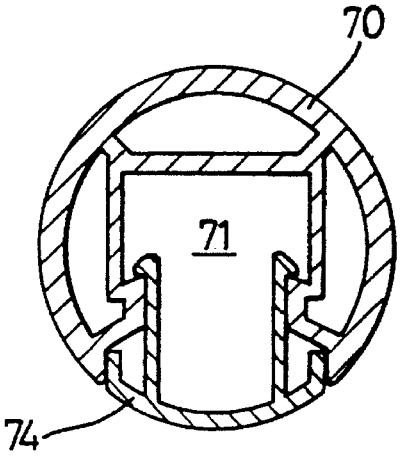
FIG. 10 is another sectional view of the handrail of FIG. 6.

Parts of the groove not occupied by the insert(s) are filled by spacer covers 74 as shown in FIG. 10.

I claim:

1. In a handrail assembly comprising a substantially continuous length of handrail having therein a longitudinally extending groove and a connector device (12,72) which enables a support post to be secured in a selected orientation relative to the length of the handrail; the improvement wherein the connector device comprises a first member (72) which is an insert slidable lengthwise of the handrail in said longitudinally extending groove in the handrail (70), a second member (12) adjustably associated with the first member by means of a retention assembly (48), the first member having formed in an external surface thereof a recess (30') of part spherical shape, the second member (12) comprising a substantially elongate body having a hollow head portion (40) and a substantially tubular tail portion (43), said portions being substantially aligned with one another along the longitudinal axis of the body, the head portion (40) of the second member comprising a part spherical outer surface (41) which conforms substantially with the shape of the recess (30') in the first member, said head portion being shaped to provide an adjustment slot (46), the retention assembly (48) being arranged to extend at least in part through said slot (46) and be adjustable such that the first and second members may be either restrained against relative movement or be substantially free for relative pivotal movement upon relative sliding movement of said confronting part spherical surfaces (30', 40).

2. A handrail assembly according to claim 1, wherein said slot (46) extends through at least 30° relative to the longitudinal axis (47) of the second member.

3. A handrail assembly according to claim 1, wherein said slot (46) extends substantially only to one side of the longitudinal axis (47) of the second member.

4. A handrail assembly according to claim 1, wherein the part spherical recess (30'), as considered in cross-section, subtends an angle of at least 80° about its center of curvature.

5. A handrail assembly, according to claim 1, wherein the hollow head portion (40) of the second member has a part spherical internal surface (42) which is dimensioned such that the wall thickness of the head portion, at least in the vicinity of the slot (46), is substantially uniform.

6. A handrail assembly according to claim 1, wherein the tail portion (43) of the second member is adapted for location in and to abut the end of a support post (63).

7. A handrail assembly according to claim 1, wherein the axial length of the tail portion (43) is less than twice the axial length of the head portion (40).

8. A handrail assembly according to claim 7, wherein the axial length of the tail portion is less than or equal to the axial length of the head portion.

9. A handrail assembly according claim 1, wherein said head portion (40) is of a substantially semi-spherical shape.

10. A handrail assembly according to claim 1, wherein the retention assembly has a head portion adapted to conform to the internal surface of the hollow head portion of the second member.

11. A handrail assembly according to claim 1, wherein the retention assembly has a head portion (50) which is spaced from the internal surface (42) of the hollow head portion (50) by an interposed washer (51) having a first surface which conforms to the underside of the head portion of the retention assembly and a second surface which conforms to the internal surface (42) of said hollow head portion.

12. A handrail assembly according to claim 1, wherein a washer (35) of resilient material is provided in a base region of the recess (30) whereby it may provide resistance to relative movement of said first and second members.

13. A handrail assembly according to claim 1, wherein said first member (72) of the connector device has an outer surface region which is part cylindrical.

14. A handrail assembly according to claim 1, which further includes a support post (63) secured to the second member (12).

15. A handrail assembly according to claim 14, wherein the handrail (70) and support post (63) are each of a kind having a longitudinal or major axis and the connector device is orientated such that said axes intersect one another.

16. A handrail assembly according to claim 14, wherein the handrail (70) and support post (63) are each of a kind having a longitudinal or major axis and the connector device is orientated such that said axes are offset.

17. A handrail assembly according to claim 14, wherein the handrail (70) comprises a curved portion and is secured to a corner post (63) at a position where the handrail is curved as viewed vertically in plan, the connector device being orientated such that the longitudinal axis of the post (63) is offset locally relative to the major axis of the handrail.

18. A handrail assembly according to claim 1, further comprising means for selectively locking the insert against axial movement in the direction of the length of the longitudinally extending groove of the handrail.

19. A handrail assembly according to claim 1, wherein the insert has formations thereon that interlock with complementary formations within the handrail groove to guide the insert in sliding movement in the groove.

20. A handrail assembly according to claim 1, wherein parts of the groove not occupied by an insert are filled by spacer covers.

* * * * *